US005894110A

United States Patent [19]

Simmons et al.

[11] Patent Number: 5,894,110

[45] Date of Patent: Apr. 13, 1999

[54] TWIST-ON WIRE CONNECTOR

[75] Inventors: David Odell Simmons; Richard Benny Clifton, both of Leander, Tex.

[73] Assignee: Minnesota Mining and Manufacturing Company, Saint Paul, Minn.

[21] Appl. No.: 08/723,560

[22] Filed: Sep. 30, 1996

[51] Int. Cl.[6] ..... H01R 4/22

[52] U.S. Cl. ..... 174/87; 206/219

[58] Field of Search ..... 174/87; 403/214, 403/396; 206/219, 221

[56] References Cited

U.S. PATENT DOCUMENTS

| | | | |
|---|---|---|---|
| 3,297,816 | 1/1967 | Waddington | 174/87 |
| 3,308,229 | 3/1967 | Burniston | 174/87 |
| 3,347,979 | 10/1967 | Hoffman | 174/87 |
| 3,676,574 | 7/1972 | Johansson et al. | 174/87 |
| 4,227,040 | 10/1980 | Scott | 174/87 |
| 4,288,657 | 9/1981 | Swanson | 174/87 |
| 4,379,807 | 4/1983 | Otis et al. | 428/383 |
| 4,691,079 | 9/1987 | Blaha | 174/87 |
| 4,740,656 | 4/1988 | Rich | 174/87 |
| 4,924,035 | 5/1990 | Miller et al. | 174/87 |
| 5,023,401 | 6/1991 | Clifton | 174/87 |
| 5,260,515 | 11/1993 | Braun, Jr. | 174/87 |
| 5,315,066 | 5/1994 | Spiteri, Sr. | 174/87 |
| 5,559,307 | 9/1996 | Whitehead et al. | 174/87 |

FOREIGN PATENT DOCUMENTS

| | | | |
|---|---|---|---|
| 1 257 238 | 12/1967 | Germany | 174/87 |
| 13 02 939 | 1/1971 | Germany . | |

*Primary Examiner*—Hyung-Sub Sough
*Assistant Examiner*—Chau N. Nguyen
*Attorney, Agent, or Firm*—Matthew B. McNutt

[57] ABSTRACT

A twist-on wire connector includes a closed end, an open end and an interior wall defining an elongated cavity. Grooves are provided in the cavity adjacent the first end. The grooves extend radially outwardly toward the wall of the cavity. Ribs extend along the walls. Each rib has a first terminal end aligned adjacent an associated one of the grooves. Each rib has a contoured surface which is convex in a direction transverse to the length of the rib. A helical coil wire insert has a contoured surface for mating engagement with the contoured ribs. The insert has a terminal wire end extending radially into one of the grooves. An annular undercut protrudes from the wall adjacent a second terminal end of each rib. The insert has an enlarged annular end engaged with the undercut, whereby the insert is retained in press-fit engagement within the cavity.

20 Claims, 4 Drawing Sheets

TWIST-ON WIRE CONNECTOR

BACKGROUND OF THE INVENTION

The present invention relates generally to a twist-on wire connector and more particularly to providing an insulator housing which receives a snap-in contoured helical spring. The interior of the housing is contoured to match the contour of the spring.

A typical twist-on wire connector includes an insulated housing of synthetic material having a metallic coil spring insert for receiving twisted, bare wire ends and gripping the wire ends which are forcibly twisted into a threaded engagement with the insert. The coil spring insert is formed by a steel wire having a corrosion resistant plating, e.g. tin, which is coiled into a tapered helical shape and coated with a lubricant which functions as a lubricant for the wire ends as they are twisted into engagement with the coiled insert. The coil insert being tapered, includes a reduced tip end and an enlarged open end. A protruding free end, or kick-out, of the coil is located at the tip end.

The housing also has a tapered configuration including a closed tip end and an enlarged open end. The tip region of the interior annular sidewall of the housing includes flat surfaced reinforcing ribs for mating engagement with the exterior surface of the tip region of the coil insert. The ribs are squared off into a right-angular engagement with the interior of the housing wall. The housing also may include exterior wings adjacent the open end for gripping when the connector and wire ends are being twisted into engagement.

When the coil insert is located in the interior of the housing, an ultrasonic welding tool causes a weld to occur between exterior coil surfaces which engage interior insulator surfaces. It is difficult to weld the kick-out in the solid mass of material in the area of the tip of the housing with consistency. Also, the force exerted by the welding tool deforms the insert to an unknown geometry. The exterior tip region of the coil is welded to the flat surfaces of the ribs during the welding operation.

The twisting engagement of the connector and the bare wire ends during the wire feeding process reveals structural limitations on the wire ends, the coil insert and the housing. When the wire is strand wire, there is clearly a limitation on the amount of torque which can be applied without damage occurring to the strands. Such damage can cause increased resistance across the connection resulting in poor static heating and current cycling. Excessive torque can also distort the wire bundle, the insert and the insulator housing, resulting in a poor electrical connection. The lubricated insert provides insufficient lubrication between the coil and wires. The flat surfaced ribs which engage the tip region of the insert, limit expansion of the coil, inhibit wire feeding to the tip of the insert and concentrate stress at the tip regions of the housing and the coil. In addition, the right-angular engagement between the ribs and the interior of the housing wall may create undesirable stress concentrations.

Excessive torque on the wire bundle can require the wire ends to be re-stripped and joined. As for the insert, excessive torque can further deform the insert within the housing. Excessive torque can also stress the tip region of the housing and cause stress-whitening adjacent the ribs which would result in dielectric failure. Occasionally, a wire end will poke through the housing tip due to excessive torque being applied during wire feeding.

Unfortunately, a suitable solution to the limitations associated with twist on wire connectors related to wire feeding, lubrication, insert distortion and insulator stress has not been satisfactorily addressed by the prior art. Therefore, what is needed is an apparatus for facilitating wire feeding into a twist-on connector. It is also highly desirable to provide a reduced stress environment for the wire and components of the connector.

SUMMARY OF THE INVENTION

The present invention, accordingly, provides twist-on wire connector having an insulator housing which receives a contoured tapered helical spring. To this end, the insulator housing has a closed first end, an open second end and a wall defining an elongated interior cavity. Grooves are formed in the cavity adjacent the first end. A helical coil wire insert is mounted in the cavity and has an elongated contoured outer wall. The insert has a protruding terminal end. Means are provided on the interior wall for locating the terminal end in one of the grooves. The locating means has an elongated contoured surface attached to the wall and adjacent the entire length of the contoured outer wall of the insert. The contoured surface and the contoured coil wall are spaced apart by a variable width space.

A principal advantage of the present invention is that the insert can be consistently located and snapped-in the housing without the need for welding, resulting in superior process control. The adjacent contoured surfaces support the insert during wire feed-in and provide improved stress distribution on the housing and the wire bundle. This arrangement accepts a wide range of wire combinations and provides exceptional stranded wire performance. This is in contrast to prior art connectors which are exposed to insert deformation during welding and wire feed-in and excessive insulator housing stress concentrations.

DESCRIPTION OF THE PREFERRED EMBODIMENT

Figure 1:
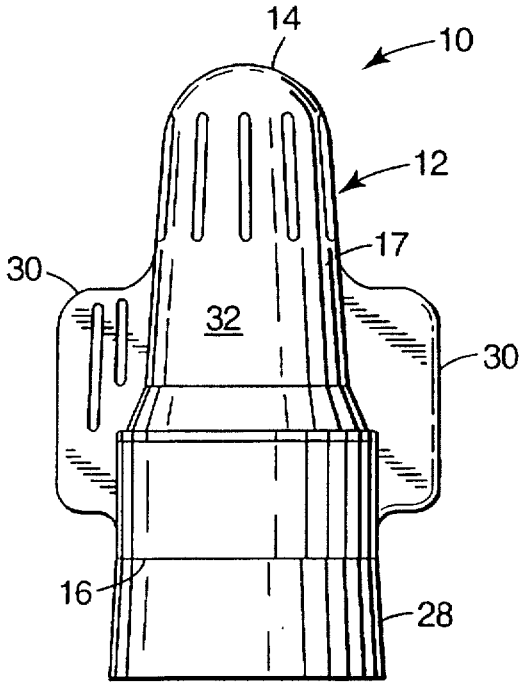
FIG. 1 front view illustrating an embodiment of the wire connector according to the present invention.
Figure 2:
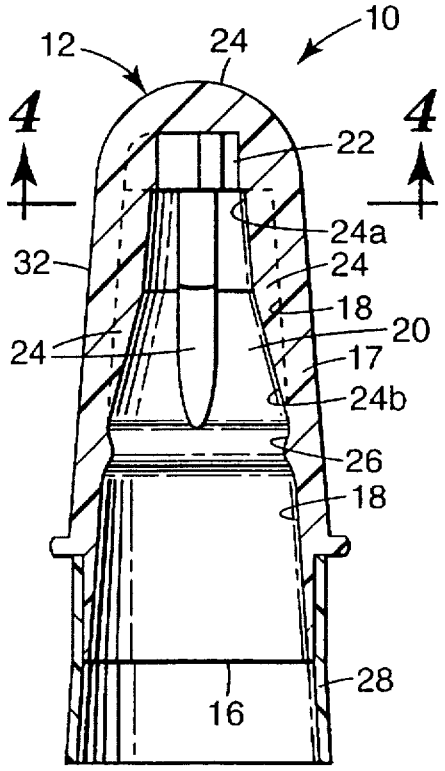
FIG. 2 is a cross-sectional side view illustrating an embodiment of the housing without an insert according to the present invention.

Referring to FIGS. 1 and 2, illustrated is a view of a twist-on wire connector generally designated 10, including a housing 12 formed of a polymeric material, for example a polyolefin or a polyamide, having a closed first end 14, an open second end 16 and a wall 17 defining an elongated cavity 20 therein. A plurality of grooves 22 are formed in the cavity 20 adjacent the first end 14. An annular undercut 26 protrudes from an interior surface 18 of wall 17. A plurality of elongated contoured ribs 24 extend along the surface 18. Each rib 24 has a first terminal end 24*a* adjacent the grooves 22 and a second terminal end 24*b* adjacent the annular undercut 26. A resilient skirt 28, formed of a thermal plastic elastomer, is attached to housing 12 at second end 16. A pair of wings 30, FIG. 1, are attached to an exterior surface 32 of wall 17.

Figure 3:
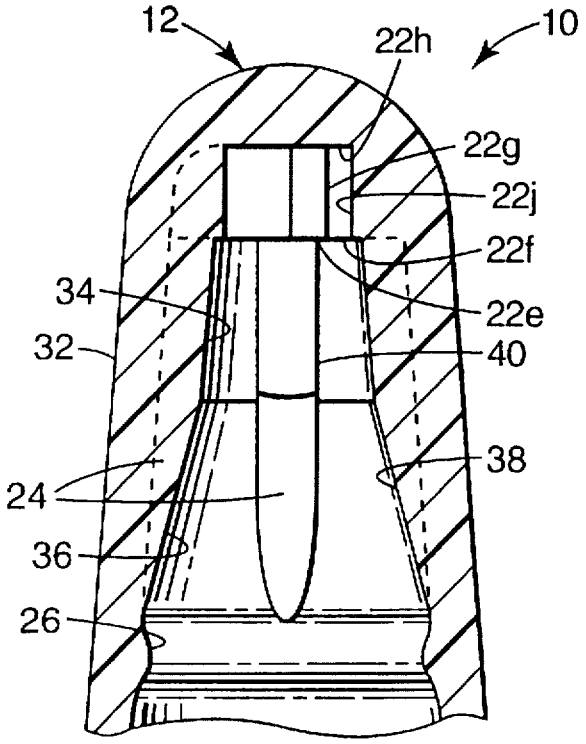
FIG. 3 is an enlarged partial cross-sectional side view illustrating an embodiment of the housing without an insert according to the present invention.
Figure 4:
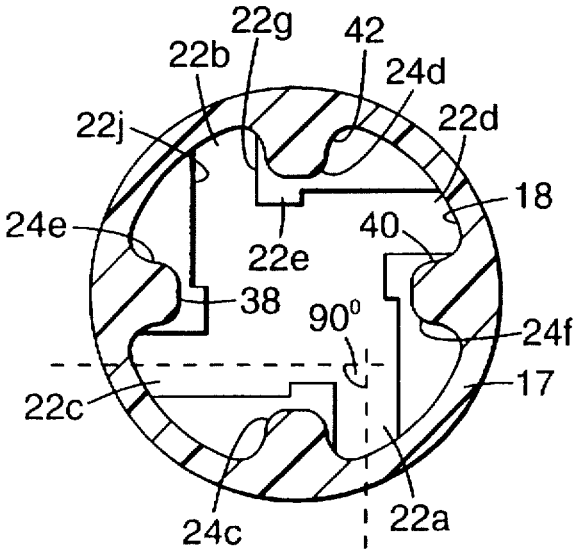
FIG. 4 is a cross-sectional view of the housing taken along line 4—4 of FIG. 2.

Grooves 22, FIGS. 3 and 4, are formed in housing 12 in pairs, although a three-groove arrangement is acceptable. One of the grooves 22*a* of each pair is diametrically offset with respect to the other groove 22*b* of the pair, as is the case with the other pair of grooves 22*c*, 22*d*. Each groove, for example groove 22*a*, is angularly disposed at 90° relative to an adjacent groove 22*c*. Each of the grooves 22 has an axial depth extending toward closed end 14. Also, each groove 22 extends radially outwardly toward surface 18 of wall 17. Each of the grooves 22 includes a lip 22*e* adjacent a groove opening 22*f*. A surface 22*g* of groove 22 extends from lip 22*e* to a bottom surface 22*h* of groove 22. Another surface 22*j* of groove 22, opposite surface 22*g*, also extends to bottom surface 22*h*.

Ribs 24, FIGS. 3 and 4, are formed with housing 12 in pairs, although a three-rib arrangement is acceptable. One of the ribs 24*c* of each pair is diametrically opposed to the other rib 24*d* of the pair, as is the case with the other pair of ribs 24*e*, 24*f*. Each rib, for example rib 24*c*, is angularly disposed at 90° relative to an adjacent rib 24*e*. Each of the ribs 24 extends from a respective one of the grooves 22 to the undercut 26. Each of the ribs 24 is contoured which may include a curvature or may include a continuous dual angle contoured surface including a first angled portion 34 adjacent grooves 22 and a second angled portion 36 adjacent undercut 26. Each of the ribs 24 includes a convex surface 38 along the entire length thereof, the surface 38 being convex in a cross-sectional direction transverse to the length of the ribs 24. Each of the ribs 24 includes a relatively flat surface 40, extending along the length thereof to lip 22*e* of an associated groove. Surface 40 is substantially aligned, i.e. slightly offset with surface 22*g* of each of the grooves 22. In addition, each of the ribs 24 interfaces with the wall surface 18 by means of fillets 42 formed therewith.

Figure 5:
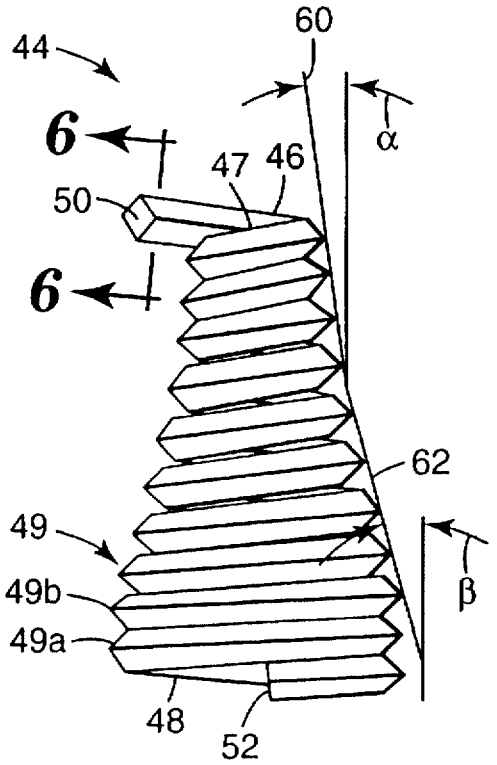
FIG. 5 is a side view illustrating an embodiment of the helical spring coil insert according to the present invention.
Figure 6:
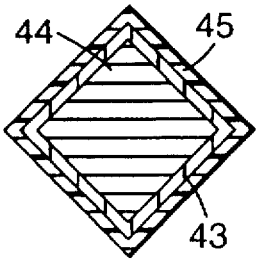
FIG. 6 is a cross-sectional view of the coil taken along line 6—6 of FIG. 5.

An insert 44, FIGS. 5 and 6, is single wound spring utilizing steel spring wire, preferably 0.040 inch square wire, zinc plated at 43 for corrosion resistance and coated with a natural or synthetic lubricant at 45 for reduced friction. Insert 44 is configured as a tapered helical spring having a plurality of variable diameter coils extending from a reduced diameter tip end 46 and an enlarged annular open end 48. A protruding free end, or kick out 50, of the wire is located at tip end 46 and extends radially outwardly therefrom to engage one of the grooves 22. Tip end 46 includes reduced diameter coils 47, one of which engages lip 22*e* when insert 44 is inserted in housing 12. Another free end 52 of the wire is located at enlarged end 48 which includes large diameter coils 49, certain ones of which engage undercut 26 depending on the installed height of insert 44.

Figure 7:
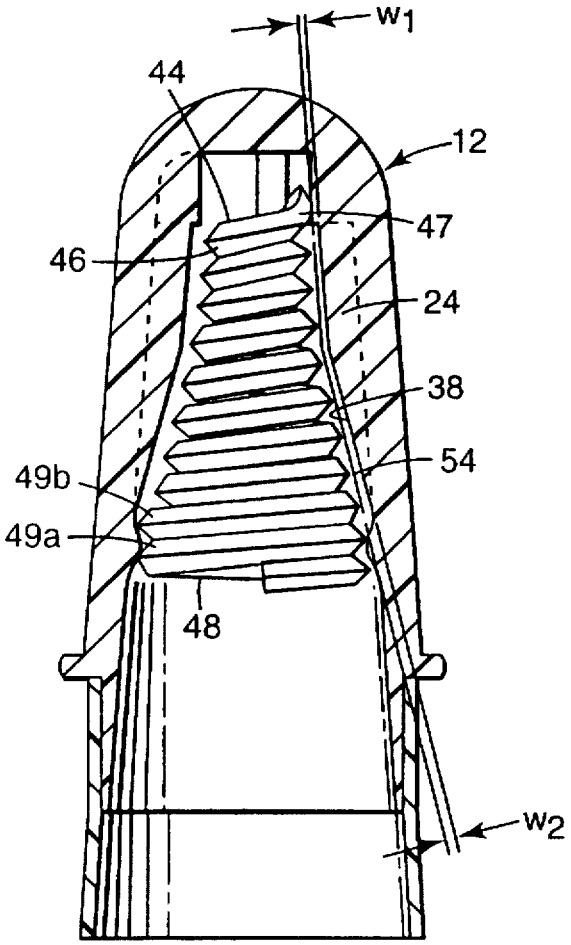
FIG. 7 is a cross-sectional side view illustrating an embodiment of the housing including a insert according to the present invention.

Insert 44, FIG. 7 has a contoured outer surface or wall 54 which is preferably marginally spaced from adjacent contoured ribs 24. There may also be no space as long as surface 54 is in non-compression with ribs 24. The outer wall 54, is contoured and may include a curvature or may include a continuous dual angle taper including a first angled portion 60 at angle α, FIG. 5, and a second angled portion 62 at angle β, greater than α. A marginal space, FIG. 7, between outer wall 54 of insert 44 and surface 38 of ribs 24 may be variable so that the space gradually decreases from a width $w_1$ to a width $w_2$ in a direction extending from enlarged end 48 of insert 44 to reduced tip end 46. Preferably, the grooves 22 are proportioned to have a width dimension extending between surfaces 22*g* and 22*j*, FIG. 3, which is from 50% to 95% of the corner-to-corner width dimension of the coiled square wire for a press-fit and from 20% to 95% of the wire width dimension when the insert 44 is to be welded into housing 12.

In operation, reduced tip end 46 of insert 44 is inserted into open end 16 of housing 12. Kick-out 50 limits insert 44 from rotation greater than 90° within cavity 20 due to engagement between kick-out 50 and one of the ribs 24. Further insertion of insert 44 into cavity 20 permits kick-out 50 to engage and be guided along surface 40 of one of the ribs 24. Ultimately, kick-out 50 is guided to one of the grooves 22 associated with the rib 24 engaged by kick-out 50 during insertion. A force applied to enlarged annular end 48 of insert 44 will urge kick-out 50 past lip 22*e* and into the respective groove 22 and cause undercut 26 to secure one of the large diameter coils 49 adjacent enlarged annular end 48. The installed height of insert 44 is deep enough into cavity 20 such that the widest portion of enlarged annular end 48 engages undercut 26 at an extreme end coil 49*a* or at least a second full coil 49*b* adjacent the extreme end coil 49*a* simultaneously with kick-out 50 being seated in one of the grooves 22 such that a reduced diameter coil 47 at reduced tip end 46 is engaged with lip 22*e*.

Figure 9:
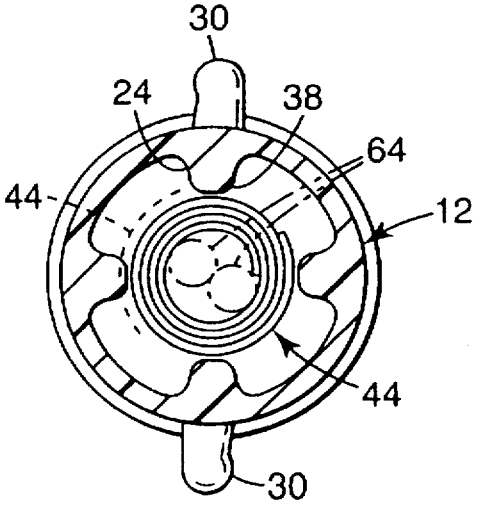
FIG. 9 is a cross-sectional view of the housing taken along line 9—9 of FIG. 7.
Figure 8:
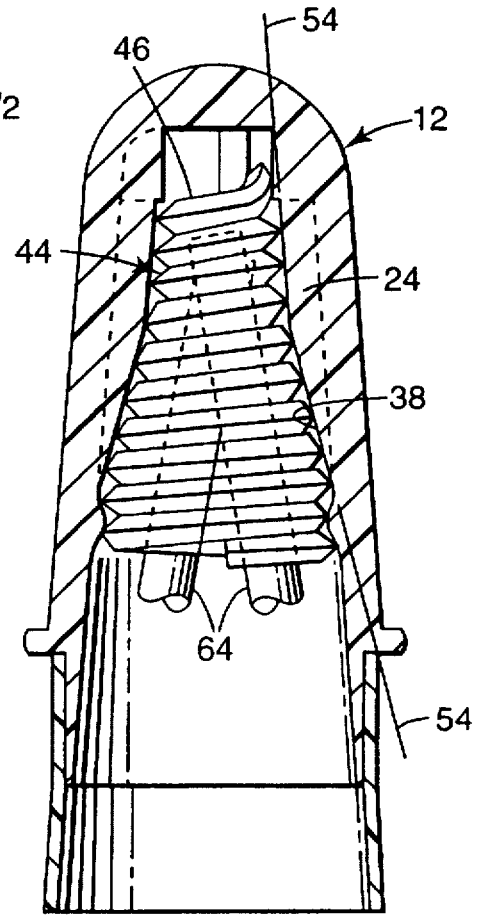
FIG. 8 is a cross-sectional side view illustrating an embodiment of the housing including an insert and a wire bundle according to the present invention.

When one or more wires 64, FIG. 8, are inserted into the installed insert 44 and a twist motion is applied to housing 12 relative to wires 64, the wires 64 are progressively fed into insert 44 due to the lubricated bite of the helical coils on the wires 64 and the expansion of the contoured wall 54 of insert 44 into engagement with the convex surface 38 of the matching contoured ribs 24. This expansion enhances wire feeding to the reduced wire tip end 46 of insert 44 without significant wrapping of the wire strands. Initial resistance to expansion is reduced by the convex surface 38 of ribs 24, see also FIG. 9. The resistance gradually increases as the coils of insert 44 expand into deeper engagement with elongated ribs 24. This provides a more distributed loading on the insulator housing 12 and reduces stress-whitening.

As it can be seen, the principal advantages of the present invention include the zinc plated coil wire which reduces friction and inhibits corrosion. The paraffin wax coating further reduces friction. The contoured insert being spaced from and substantially matching the contoured ribs with a convex contact surface, permits large wire combinations to first begin feeding into the reduced tip of the insert with a progressively increasing spring force and then limits an excessively high ultimate spring force. This also limits the torque required to poke through the increased thickness of closed end of the housing. As a result, the wire bundle continues to feed deeper into the insert with less required torque. This also increases pullout performance for both retaining the wires in the insert and retaining the insert in the housing, e.g. the security of insulation test.

The insulator housing includes extended-length contoured ribs substantially matched with the profile of the coil insert. The grooves receive the kick-out at the reduced tip end of the insert to facilitate ultrasonic welding if desired or for press-fitting the insert into the housing. As a result of the kick-out inserting into a groove and not having to be forced into a solid mass of material during welding, the insert experiences less distortion. This reduction in distortion correlates into increased consistency in mechanical and electrical performance. The fillets between the ribs and the housing wall, as well as increased wall thickness minimize stress in the housing wall.

The contoured rib profile distributes stress applied by the insert over a larger area of the insulator by increasing the number of points where the spring engages the insulator. The additional contact points also provide improved mechanical and electrical performance by establishing more active spring coils, i.e. coils engaged with the wire bundle. The contoured rib profile is further intended to allow the wire bundle to feed further into insulator without significant wrapping of wire strands. Together, these characteristics are believed to be primary contributions to the connector of the present invention being highly insensitive to installation technique, including the number of turns required to make a reliable mechanical and electrical connection.

The elongated rib profile approximates the profile of the insert and allows a small gap or at least a non-compressive fit therebetween. This allows the coils of the insert to be compressed into the ribs as the coils are expanded by the conductors feeding in. In addition, the cross-sectional rib profile, i.e. convex, provides a progressively increasing resistance against the insert coils compressing into the ribs as the wires feed into the insert.

To reduce the stress in the walls of the insulator housing; the wall thickness is increased to 0.040 inches and fillets of 0.030 inches are provided at the rib to wall interface. This limits large wire combinations from deforming the insulator housing to a point where the housing material will stress-whiten at the rib to wall interface. The dimension including the radial depth of the grooves and the thickness of the housing wall satisfies flammability requirements. The thickness of the tip of the closed end of the insulator housing raises the torque to poke through the tip.

Although illustrative embodiments of the invention have been shown and described, a wide range of modification, change and substitution is contemplated in the foregoing disclosure and in some instances, some features of the present invention may be employed without a corresponding use of other features. Accordingly, it is appropriate that the appended claims be construed broadly and in a manner consistent with the scope of the invention.

What is claimed is:

1. A twist-on wire connector comprising:

an insulator housing having a closed first end, an open second end and a wall defining an elongated cavity therein;

a plurality of grooves formed in the cavity adjacent the first end, said grooves extending from the first end toward the second end and each of said grooves having a terminal end located between the first end of the housing and the second end of the housing;

a helical coil wire insert mounted in the cavity and having an elongated contoured outer wall, the insert having a protruding terminal wire end; and ribs for locating the terminal wire end in one of the grooves, said ribs attached to the housing wall and extending from the terminal end of said grooves toward the second end of the housing, the ribs having an elongated contoured surface adjacent the entire length of the contoured outer wall of the coil, the contoured surface and the contoured outer wall of the coil defining a variable width space therebetween.

2. The wire connector as defined in claim 1 wherein the grooves are formed in pairs, one of the grooves of each pair being diametrically offset with respect to the other groove of the pair.

3. The wire connector as defined in claim 2 wherein the elongated contoured surface of each of said ribs being an insert engaging surface convex in a cross-sectional direction transverse to the length thereof and having a side surface substantially aligned with a surface of an associated one of the grooves.

4. The wire connector as defined in claim 3 wherein each of said grooves includes a lip and the side surface of each rib terminates at the lip of an associated groove.

5. A twist-on wire connector comprising:

an insulator housing having a closed first end, an open second end and a wall defining an elongated annular cavity therein;

a plurality of grooves formed in the cavity adjacent the first end, the grooves extending radially outwardly toward the wall of the cavity and further extending longitudinally toward the second end of the housing, the grooves terminating at a terminal end located between the first end of the-housing and the second end of the housing;

a plurality of elongated ribs having a contoured surface, the ribs extending along the wall, each of said ribs having a first terminal end substantially aligned adjacent an associated terminal end of one of the grooves, the contoured surface of each rib also being convex in a cross-sectional direction transverse to the length thereof; and a tapered helical coil wire insert having a contoured outer wall for mating engagement with the contoured surface of the ribs, the insert having a terminal wire end extending radially therefrom and engaged in one of the grooves.

6. The wire connector as defined in claim 5 wherein each of said grooves includes a lip adjacent the first terminal end of said ribs.

7. The wire connector as defined in claim 5 wherein the contoured outer wall of the insert and the contoured surface of each rib include a dual angle tapered surface.

8. The wire connector as defined in claim 5 wherein the wire insert is plated with a corrosion resistant material and coated with a wax lubricant.

9. The wire connector as defined in claim 5 wherein each of said ribs interfaces with the wall by means of a fillet formed therewith.

10. The wire connector as defined in claim 6 further comprising an annular undercut protruding from the wall adjacent a second terminal end of each of the ribs, the insert being formed of a plurality of variable diameter coils, some of the coils forming an enlarged annular end, at least one of the coils immediately adjacent the enlarged end being engaged with the annular undercut when the terminal wire end is seated in one of the grooves, whereby the insert is retained in press-fit engagement within the cavity.

11. The wire connector as defined in claim 5 wherein the insert is formed of a wire having a square cross-section, the grooves having a width of a first size and the wire having a corner-to corner width of a second size, the first size having a dimension of from about 20% to about 95% of the dimension of the second size.

12. The wire connector as defined in claim 10 wherein some of the coils form a reduced tip end, including the terminal wire end and a first coil, the first coil being engaged with the lip when the terminal wire end is seated in one of the grooves.

13. The wire connector as defined in claim 5 wherein the grooves are formed in opposed, diametrically offset pairs.

14. The wire connector as defined in claim 8 wherein the contoured outer wall of the insert and the contoured surface of the ribs define a marginal space therebetween, the space being variable so as to gradually decrease in a direction extending from the open end of the insulator to the closed end thereof.

15. The wire connector as defined in claim 14 wherein the plated wire insert, the wax lubricant and the variable space between the insert and the ribs provide for facilitated feeding of a wire bundle into the insert.

16. The wire connector as defined in claim 5 wherein each of said grooves and associated ribs is angularly disposed at 90° relative to an adjacent one of the grooves and associated ribs.

17. A twist-on wire connector comprising:

an insulator housing having a closed first end, an open second end and a wall defining an elongated annular cavity therein;

a plurality of grooves formed in the cavity adjacent the first end, the grooves extending radially outwardly toward the wall of the cavity;

a plurality of elongated ribs extending along the wall, each of said ribs having a first terminal end aligned adjacent an associated terminal end of one of the grooves, each of said ribs having a contoured surface along the length thereof, the surface also being convex in a cross-sectional direction transverse to the length of the rib; and a tapered helical coil wire insert having an elongated contoured outer surface extending from a reduced annular end of the insert to an enlarged annular end thereof, the contour of the outer surface of the insert substantially matching the contoured surface of the ribs and being marginally spaced therefrom, the space being variable between the contoured surface of the ribs and the outer contoured surface of the insert so as to gradually decrease in a direction extending from the enlarged end to the reduced end.

18. The wire connector as defined in claim 17 further comprising an annular undercut protruding from the wall adjacent a second terminal end of each of the ribs.

19. The wire connector as defined in claim 18 wherein the helical coil wire insert has an enlarged annular end engaged with the annular undercut, whereby the insert is retained in press-fit engagement within the cavity.

20. The wire connector as defined in claim 17 wherein each of said grooves includes a lip coincident with the first terminal end of an associated one of the ribs.

* * * * *